US005305498A

United States Patent [19]

Lang

[11] Patent Number: 5,305,498

[45] Date of Patent: Apr. 26, 1994

[54] ARRANGEMENT FOR CLEANING A PRESSURE ROLLER OF A DRAFTING UNIT

[75] Inventor: Kurt Lang, Lauterstein, Fed. Rep. of Germany

[73] Assignees: Fritz Stahlecker, Bad Ueberkingen; Hans Stahlecker, Suessen, both of Fed. Rep. of Germany

[21] Appl. No.: 794,240

[22] Filed: Nov. 19, 1991

[30] Foreign Application Priority Data

Nov. 21, 1990 [DE] Fed. Rep. of Germany ..... 4037006

[51] Int. Cl.[5] ..... D01H 5/60

[52] U.S. Cl. ..... 19/263; 19/265

[58] Field of Search ..... 19/262, 263, 264, 265, 19/236, 245; 57/300, 301, 304, 305

[56] References Cited

U.S. PATENT DOCUMENTS 3,020,600 2/1962 West ..... 19/262

3,074,121 1/1963 Barr, Jr. et al. ..... 19/263

4,662,167 5/1987 Stahlecker ..... 57/304

4,739,540 4/1988 Hill ..... 19/263

5,119,622 6/1992 Stahlecker ..... 19/263

FOREIGN PATENT DOCUMENTS 1510603 2/1970 Fed. Rep. of Germany .

3924568 2/1990 Fed. Rep. of Germany .

*Primary Examiner*—Clifford D. Crowder

*Assistant Examiner*—Michael A. Neas

*Attorney, Agent, or Firm*—Evenson, McKeown, Edwards & Lenahan

[57] ABSTRACT

In the case of an arrangement for the cleaning of the circumferential surface of a delivery roller pair of a drafting unit of a spinning machine, devices are provided for the reinforcing of the cleaning effect while the drafting unit starts up again after a stoppage. Heating devices are also disclosed for heating the pressure rollers before a piecing operation is started.

21 Claims, 1 Drawing Sheet

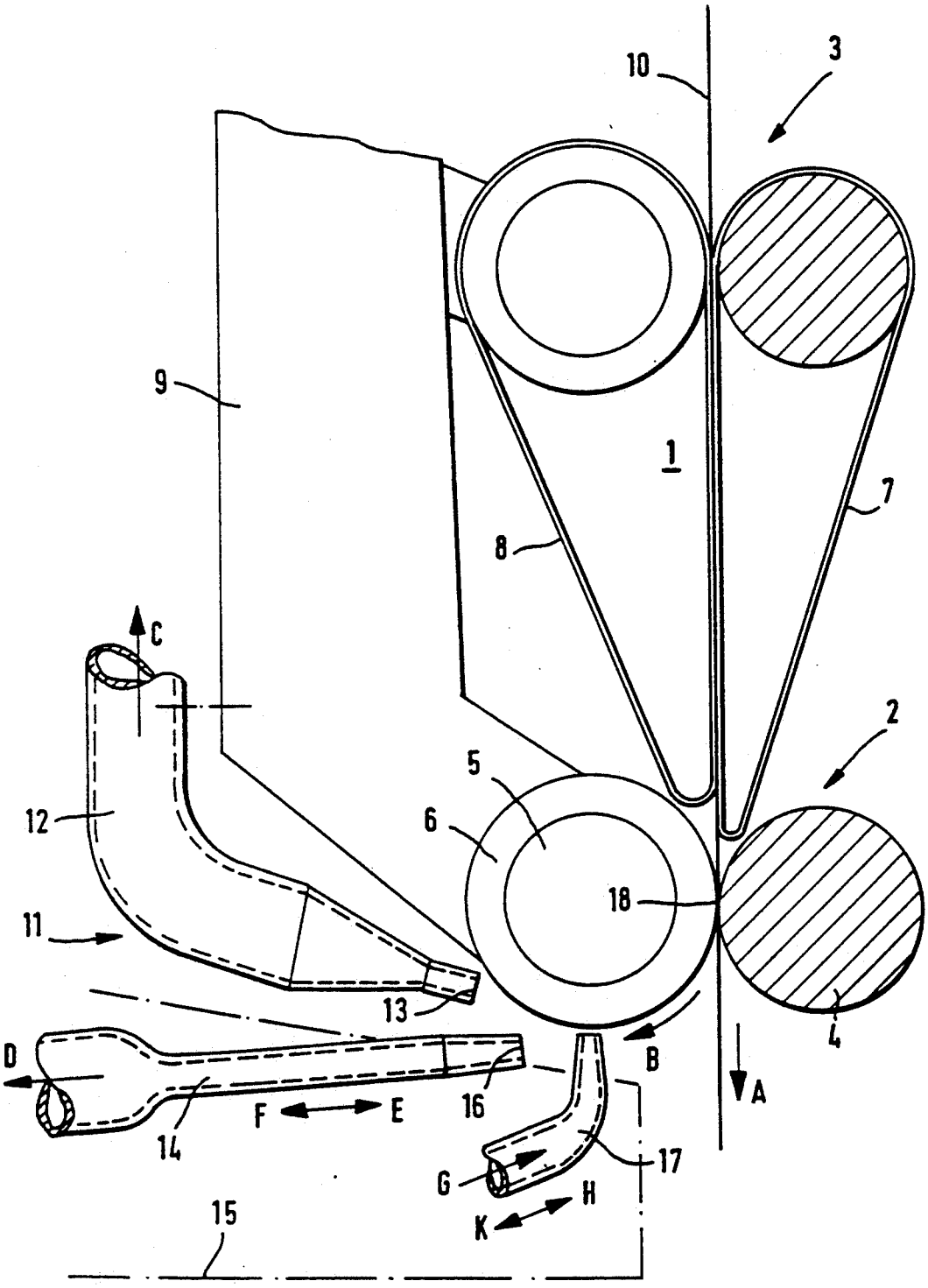
10
3
9
1
7
8
C
2
5
6
12
18
11
13
4
D
B
A
16
F
E
14
17
G
H
K
15

ARRANGEMENT FOR CLEANING A PRESSURE ROLLER OF A DRAFTING UNIT

BACKGROUND AND SUMMARY OF THE INVENTION

The present invention relates to an arrangement for cleaning the circumferential surface of a pressure roller of a pair of delivery rollers of a drafting unit of a spinning machine, having a suction device assigned to the circumferential surface of the pressure roller.

In the case of an arrangement of the initially mentioned type (German Patent Document DE-OS 15 10 603), the suction device has the purpose of providing that the pressure roller of the pair of delivery rollers will be cleaned continuously during the normal spinning operation, and that, after a yarn breakage, a lap formation is prevented on the pair of delivery rollers. In particular, for the latter purpose, a relatively strong vacuum is necessary so that this arrangement has a relatively high energy requirement.

It is also known (German Patent Document DE 39 24 568 A1) to mount a suction nozzle on a servicing carriage that can be moved along a spinning machine, which suction nozzle is applied during a servicing operation to an area between a delivery roller pair of a drafting unit and a twisting element which follows, and cleans this area.

The invention is based on the object of developing an arrangement of the initially mentioned type such that only a reduced energy requirement is necessary without limiting the operatability.

This object is achieved in that devices are provided for reinforcing the cleaning effect during a restarting of the drafting unit after a stoppage.

The invention is based on the recognition that, during the normal spinning operation, only relatively low cleaning forces, particularly suction forces, are required in order to keep the pressure roller clean. This increased cleaning effect is provided only when it is actually required, specifically during the restarting of the drafting unit after a stoppage. As a result, it is possible to clearly reduce the energy consumption since only the actually required energy needs to be use up.

In the case of an expedient development of the invention, it is provided that the suction device, during the restarting of the drafting unit, can be operated with an increased vacuum. In a further development, it is provided in this case that two suction nozzles are assigned to the pressure roller of the pair of delivery rollers, one of the suction nozzles being drivable with an increased vacuum. As a result, a simplified switching is achieved which does not require throttle valves or the like.

In a further development of the invention, it is provided that the suction nozzle which can be driven with the stronger vacuum is held so that it can be applied to the pressure roller. In this case, it is particularly advantageous for the applicable suction nozzle to be arranged in a servicing carriage which can be moved along the spinning machine. For increasing the cleaning effect, this suction nozzle will then be applied to the corresponding spinning point during a piecing operation of the pressure roller of the drafting unit.

The invention can particularly advantageously be used in the case of spinning machines in which the drafting units are stopped when a yarn breakage occurs. The wind-around spinning machine "Parafil 2000" manufactured by Spindelfabrik Süssen, is, for example, equipped with drafting units of this type. In the case of this spinning machine, a load carrier with the pressure rollers is swivelled away from the bottom cylinders in the case of a yarn breakage. Likewise, spinning machines are known in which autonomous drafting units are provided for each spinning point which can be stopped individually. It was found that in such cases the coverings of the pressure rollers fall relatively fast from their operating temperature to the ambient temperature. In this case, the phenomenon will then occur that the colder coverings have a higher adhesive effect with respect to the fibers so that the danger of lap formations after the start exists to an increased extent in these cases.

In order to reduce, particularly in the case of drafting units that can be stopped after a yarn breakage, the danger of lap formation from the start and thus lower the required cleaning effect, devices for the heating of the pressure rollers that can be switched on and off are provided as a further development of the invention. As a result, it is possible to heat the pressure roller such that the operational adhering forces exist so that then also the operational cleaning effects are sufficient. In an expedient development of the invention, it is provided in this case that the devices for the heating of the pressure roller are arranged in a servicing carriage which can be moved along the spinning machine. Since this servicing carriage, as a rule, carries out the piecing operation, it will then be sufficient to provide the devices for the heating only once. In a simple embodiment of the invention, at least one nozzle which blows out heated air or the like is provided as the device for the heating.

Other objects, advantages and novel features of the present invention will become apparent from the following detailed description of the invention when considered in conjunction with the accompanying drawings.

BRIEF DESCRIPTION OF THE DRAWINGS

The single drawing figure is a schematic partially sectional cutout representation of a drafting unit with an arrangement according to the invention.

DETAILED DESCRIPTION OF THE DRAWINGS

The drawing illustrates a delivery roller pair 2 and a preceding roller pair 3 of a drafting unit 1 of a spinning machine which has a plurality of spinning points with a corresponding number of drafting units 1. The delivery roller pair 2 has a drivable bottom roller 4 which may be constructed as a bottom cylinder extending through in the longitudinal direction of the machine and driven in the headstock or as an individually driven roller end. A pressure roller 5, which is provided with a covering 6 of a rubber-elastic material on its circumference, is pressed against this bottom roller 4 while forming a nip line 18. The pressure roller 5, just like the pressure rollers of the preceding roller pairs, is held by a common load carrier 9 which, in a manner not shown in detail, is provided with spring devices which press the pressure rollers 5 and the other pressure rollers against the corresponding bottom rollers. The roller pair 3, which precedes the delivery roller pair 2, is provided with an apron guide comprising a bottom apron 7 and a top apron 8.

The drafting unit 1 is used for the drafting of a sliver 10 which passes through the drafting unit 1 and travels in the direction of the arrow (A) to a device for providing a twist or a false twist which is not shown. The pressure roller 5 therefore rotates in the direction of the arrow (B).

A cleaning device 11 is assigned to the pressure roller 5 of the delivery roller pair 2. This cleaning device 11 comprises a suction nozzle 12 which is connected to a vacuum source which is not shown in detail and which generates an air current in the direction of the arrow (C). The suction nozzle 12 is mounted, for example, on the load carrier 9. It has a slot-shaped mouth 13 which extends along the axial length of the pressure roller 5 and which is aligned approximately tangentially with respect to the circumference of the pressure roller 5 against the rotating direction (B). The mouth 13 of the suction nozzle 12 is arranged at a very short distance from the circumference of the pressure roller 5. The suction nozzle 12, the mouth 13 of which is arranged to be offset by approximately 180° with respect to the nip line 18, is used for the continuous cleaning of the covering 6 of the pressure roller 5 during the normal spinning operation. Since, in this case, only individual fibers or the like are taken off, a relatively weak vacuum is sufficient. This vacuum, which is generated by a vacuum source which is not shown, must be adapted to the respective spinning conditions, that is, to the fiber material and to the operating speeds.

In order to achieve an increased cleaning effect for the pressure roller 5, a second suction nozzle 14 is provided which, in the case of the illustrated embodiment, is a component of a servicing carriage 15 which is indicated by a dash-dotted line, and which can be moved along the spinning machine, and can be applied to the individual spinning points for carrying out the servicing work, particularly for carrying out an automatic piecing after a yarn breakage. The suction nozzle 14 also has a slot-shaped mouth 16 which extends in parallel to a shell surface of the pressure roller 5. This mouth 16 is essentially aligned tangentially and against the rotating direction (B) of the pressure roller 5 and can be moved relative to the latter in the direction of the double arrow (F-E) for the applying and for the removing. The suction nozzle 14 is connected to a vacuum source which is not shown and which generates a suction air current which is indicted by an arrow (D) and has a significantly higher vacuum. The suction nozzle 14 can be applied to the pressure roller 5 in the area between the nip line 18 and the mouth 13 of the suction nozzle 12. The suction nozzle 14 is required only during the restarting of the drafting unit, that is, during the restart spinning after the yarn breakage. During this time period, an air current is then essentially sucked off in the tangential direction of the pressure roller 5 by means of a strong vacuum so that a lap formation is securely avoided during the restarting.

The servicing carriage 15 is also provided with a device 17 for the heating of the pressure roller 5, particularly of the covering 6 of the pressure roller 5. The device comprises a blow nozzle 17 which can be applied in the direction of the double arrow (K-H) to the pressure roller 5 and into which, for example, hot air is blown in the direction of the arrow (G). By means of the heating of the covering 6, it can be achieved that the danger of a lap formation is reduced. The blow nozzle 17 is withdrawn as soon as the drafting unit 1 restarts, that is, the pressure roller 5 rotates in the direction of the arrow (B).

In the case of a modified embodiment, an electric radiant heating system with one or several heating wires is provided for the heating of the covering 6 of the pressure roller 5 instead of a blow nozzle 17. These heating wires may be arranged stationarily or may be a component of a drivable servicing carriage.

In the case of a modified embodiment of the invention, it is provided that the suction nozzle 12 can be connected to two vacuum sources of varying strengths by way of a reversing valve. As a result, it is possible to provide, during a starting of the machine, at all spinning points simultaneously an increased cleaning effect for the pressure rollers 5 of all spinning points so that lap formations are excluded there. After the starting, the suction nozzle 12 may then be switched back to the weaker vacuum.

In order to provide an increased cleaning effect during the starting of the drafting unit, it is provided, in the case of a modified embodiment, that the suction nozzle 12 is arranged to be movable such that, by means of its mouth 13, for increasing the cleaning effect, it can be pressed against the circumferential surface of the covering 6 of the pressure roller. As a result a scraping cleaning effect is then obtained in addition to the suction effect which is maintained only during the starting. In this case, an elastic lip or the like can be mounted on the mouth 13 of the suction nozzle 12.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An arrangement for cleaning the circumferential surface of a pressure roller of a pair of delivery rollers of a drafting unit of a spinning machine, comprising:

a cleaning suction device assigned to the circumferential surface of the pressure roller for cleaning the pressure roller during normal spinning operations, increased cleaning apparatus for increasing cleaning effects on the circumferential surface of the pressure roller to a higher level than during normal spinning operations, and selectively operable actuating apparatus for selectively actuating the increased cleaning apparatus during a restarting of the drafting unit after a stoppage for deactuating the increased cleaning apparatus during normal spinning operations, wherein the cleaning suction device includes a first suction nozzle assigned to the pressure roller of the pair of delivery rollers, and wherein the increased cleaning apparatus includes a second suction nozzle which is operable with a stronger vacuum than the first nozzle.

2. An arrangement according to claim 1, wherein the second suction nozzle is aimed with a stronger vacuum at an area of the circumferential surface of the pressure roller which is closer to a nip line of the pair of delivery rollers than is the first suction nozzle.

3. An arrangement according to claim 1, wherein at least one of the suction nozzles is arranged approximately tangentially to the pressure roller.

4. An arrangement according to claim 3, wherein the second suction nozzle is aimed with a stronger vacuum at an area of the circumferential surface of the pressure roller which is closer to the nip line of the pair of delivery rollers than is the first suction nozzle.

5. An arrangement according to claim 1, comprising a holding device for holding the second suction nozzle so that it can be selectively applied to the pressure roller.

6. An arrangement according to claim 5, wherein the second suction nozzle is arranged in a servicing carriage which can be moved along the spinning machine to respective spinning units to be serviced.

7. An arrangement according to claim 1, wherein the first and second suction nozzles are directed against the travelling direction of the pressure roller.

8. An arrangement for cleaning the circumferential surface of a pressure roller of a pair of delivery rollers of a drafting unit of a spinning machine, comprising:

a cleaning suction device assigned to the circumferential surface of the pressure roller for cleaning the pressure roller during normal spinning operations, increased cleaning apparatus for increasing cleaning effects on the circumferential surface of the pressure roller to a higher level than during normal spinning operations, and selectively operable actuating apparatus for selectively actuating the increased cleaning apparatus during a restarting of the drafting unit after a stoppage for deactuating the increased cleaning apparatus during normal spinning operations, wherein the increased cleaning apparatus includes selectively operable hating apparatus for the heating of the pressure roller.

9. An arrangement according to claim 8, wherein the increased cleaning apparatus includes an arrangement for applying an increased vacuum to the cleaning suction device during the restarting of the drafting unit as compared to vacuum applied during normal spinning operations.

10. An arrangement according to claim 8, wherein the cleaning suction device includes a first suction nozzle assigned to the pressure roller of the pair of delivery rollers, and wherein the cleaning reinforcement device includes a second suction nozzle which is operable with a stronger vacuum than the first nozzle, and wherein the first and second suction nozzles are directed against the travelling direction of the pressure roller.

11. An arrangement according to claim 8, wherein the heating apparatus includes at least one heating nozzle which blows out heated air.

12. An arrangement according to claim 8, wherein the heating apparatus for the heating of the pressure roller is arranged in a servicing carriage which can be moved along the spinning machine.

13. An arrangement according to claim 12, wherein the heating apparatus includes at least one heating nozzle which blows out heated air.

14. An arrangement according to claim 12, wherein the cleaning suction device includes a first suction nozzle assigned to the pressure roller of the pair of delivery rollers, and wherein the cleaning reinforcement device includes a second suction nozzle which is operable with a stronger vacuum than the first nozzle, and wherein the first and second suction nozzles are directed against the travelling direction of the pressure roller.

15. An arrangement according to claim 13, wherein the cleaning suction device includes a first suction nozzle assigned to the pressure roller of the pair of delivery rollers, and wherein the cleaning reinforcement device includes a second suction nozzle which is operable with a stronger vacuum than the first nozzle, and wherein the first and second suction nozzles are directed against the travelling direction of the pressure roller.

16. An arrangement for cleaning the circumferential surface of a pressure roller of a pair of delivery rollers of a drafting unit of a spinning machine, comprising:

a cleaning suction device assigned to the circumferential surface of the pressure roller for cleaning the pressure roller during normal spinning operations, increased cleaning apparatus for increasing cleaning effects on the circumferential surface of the pressure roller to a higher level than during normal spinning operations, selectively operable actuating apparatus for selectively actuating the increased cleaning apparatus during a restarting of the drafting unit after a stoppage for deactuating the increased cleaning apparatus during normal spinning operations, and a mobile servicing carriage for servicing the drafting unit, wherein the increased cleaning apparatus includes at least one component carried on the servicing carriage, and wherein the increased cleaning apparatus includes a suction nozzle carried by the servicing carriage.

17. An arrangement for cleaning the circumferential surface of a pressure roller of a pair of delivery rollers of a drafting unit of a spinning machine, comprising:

a cleaning suction device assigned to the circumferential surface of the pressure roller for cleaning the pressure roller during normal spinning operations, increased cleaning apparatus for increasing cleaning effects on the circumferential surface of the pressure roller to a higher level than during normal spinning operations, selectively operable actuating apparatus for selectively actuating the increased cleaning apparatus during a restarting of the drafting unit after a stoppage for deactuating the increased cleaning apparatus during normal spinning operations, and a mobile servicing carriage for servicing the drafting unit, wherein the increased cleaning apparatus includes at least one component carried on the servicing carriage, and wherein the increased cleaning apparatus includes a heating device for heating a pressure roller.

18. An method for cleaning the circumferential surface of a pressure roller of a pair of delivery rollers of a drafting unit of a spinning machine, comprising:

operating a cleaning suction device assigned to the circumferential surface of the pressure roller for cleaning the pressure rollers during normal spinning operations, and selectively operating an increased cleaning apparatus to increase the cleaning effects on the circumferential surface of the pressure roller as compared to normal spinning operations, during a restarting of the drafting unit after a stoppage, wherein the increased cleaning apparatus includes a heating device for heating a pressure roller, and wherein the selectively operating an increased cleaning apparatus includes actuation of said heating unit during a restarting of the drafting unit after a stoppage.

19. A method according to claim 18, wherein the selectively operating an increased cleaning apparatus includes applying an increased vacuum to the cleaning suction device during the restarting of the drafting unit.

20. A method for cleaning the circumferential surface of a pressure roller of a pair of delivery rollers of a drafting unit of a spinning machine, comprising:

operating a cleaning suction device assigned to the circumferential surface of the pressure roller for cleaning the pressure rollers during normal spinning operations, and selectively operating an increased cleaning apparatus to increase the cleaning effects on the circumferential surface of the pressure roller as compared to normal spinning operations, during a restarting of the drafting unit after a stoppage, wherein the cleaning suction device includes a first suction nozzle assigned to the pressure roller of the pair of delivery rollers, and wherein the selectively operating an increased cleaning apparatus includes actuation of a second suction nozzle which is operable with a stronger vacuum than the first nozzle.

21. A method according to claim 20, further comprising aiming the second suction nozzle with a stronger vacuum at an area of the circumferential surface of the pressure roller which is closer to a nip line of the pair of delivery rollers than is the first suction nozzle.

* * * * *